US005265683A

United States Patent [19]

Krasnov

[11] Patent Number: 5,265,683

[45] Date of Patent: Nov. 30, 1993

[54] FLOOR DRIVE DRILLING SYSTEM

[76] Inventor: Igor Krasnov, 8002 Oakwood Forest Dr., Houston, Tex. 77040

[21] Appl. No.: 871,949

[22] Filed: Apr. 22, 1992

[51] Int. Cl.[5] ..... E21B 19/14

[52] U.S. Cl. ..... 175/52; 175/85; 175/171; 175/423; 173/164

[58] Field of Search ..... 175/52, 85, 171, 195, 175/423; 173/164, 167, 149; 166/77.5

[56] References Cited

U.S. PATENT DOCUMENTS

| | | | |
|---|---|---|---|
| 3,460,638 | 10/1966 | Millsapps, Jr. | 175/85 |
| 3,554,298 | 1/1971 | Klein | 175/85 X |
| 3,695,363 | 10/1972 | Kelly, Jr. | 175/85 X |
| 3,722,603 | 3/1973 | Brown | 173/164 X |
| 3,750,769 | 8/1973 | Young et al. | 175/85 |
| 4,128,135 | 12/1978 | Mitchhart et al. | 175/85 |
| 4,585,079 | 4/1986 | Lemaire et al. | 173/164 |
| 4,813,493 | 3/1989 | Shaw et al. | 173/164 |
| 4,821,814 | 4/1989 | Willis et al. | 173/164 |

*Primary Examiner*—Ramon S. Britts
*Assistant Examiner*—Frank S. Tsay
*Attorney, Agent, or Firm*—Joseph R. Dwyer

[57] ABSTRACT

A floor drive drilling system comprising a pipe drive bushing having a frame and a rotor which is raised and movable to and from a master bushing by wheels and lowered and coupled to the master bushing for rotary drilling and reaming. The rotor is driven by the master bushing and has a plurality of gripper assemblies which selectively engage the drill string to transfer torque thereto and are movable upward and downward a selected distance for drilling and reaming. Each gripper assembly comprises actuating rings and jaws for gripping and ungripping the drill string. Frictional inserts with large surface areas and grooves are positioned on the jaws to allow mud and contaminants to escape and means are provided for cushioning the engagement of the inserts with the drill pipe to reduce surface damage. Sensing means indicate the grip and ungripped position of the jaws and are used to indicate when a joint or other obstacle prevents the pipe being fully gripped. Also disclosed is a method for floor drive rotary drilling and reaming. The pipe drive bushing may also be used with casing.

27 Claims, 14 Drawing Sheets

FLOOR DRIVE DRILLING SYSTEM

BACKGROUND OF THE INVENTION

This invention relates to a method and apparatus for drilling oil and gas wells whether onshore or offshore.

More specifically, this invention is directed to an improvement in drive systems for rotary drilling and reaming operations without a kelly or kelly bushing.

There are two known drive systems for drilling oil and gas wells without the kelly and kelly bushing. These systems are the top drive drilling system and the side drive drilling system. A top drive system is shown and described in the U.S. Pat. Nos. 4,421,179, 4,449,596 and 4,458,768 to Boyadjieff and a side drive system is shown and described in the U.S. Pat. Nos. 4,685,915 to Goris and 4,875,529 to Wetch et al. The latter is characterized as being rail-less. Other patents related to this matter are U.S. Pat. Nos. 4,437,524 and 3,009,521.

The top drive system requires a large power source at the top of the drill string and travels up and down with the drill string and the side drive system transfers the power from the rotary table to the top of the drill string through a drive assembly which moves along a vertical drive shaft. Both these systems have advantages including the capability of drilling and reaming in triples and have performed very well even though both systems require the torque transfer means to travel the full length from the rig to the top of the derrick and visa versa.

On the other hand, there has always been a need to drive the drill pipe for drilling or reaming close to the power source on the floor of the drilling rig using the existing source of rotation without adding expensive secondary means and without a kelly or kelly bushing and this invention fulfills this need.

As will be apparent from a study of the following, this invention is a floor drive rotary drilling system without a kelly or kelly bushing and has a number of advantages;

uses the existing source of rotation, does not interfere with conventional rotary table drilling operations, provides a drilling system which is positionable directly on the drilling rig floor and thus does not require movable overhead power systems above the rig floor, requires only a portion of the drive system to travel in contrast to the prior art systems which require the entire drive system to travel downward and upward with the drill string between the rig floor and the top of the derrick during drilling and reaming operations, and is releasably and easily coupled to a selected drilling rig to allow temporary placement on a selected rig thus allowing the invention to selectively serve a number of drilling rigs.

SUMMARY OF THE INVENTION

The floor drive rotary drilling system as an apparatus and method which accomplishes the foregoing advantages comprises a pipe drive bushing having a frame and a rotor. The pipe drive bushing is raised and movable to and from the master bushing by wheels and lowered and coupled to the master bushing for rotary drilling and reaming. The rotor is driven by the master bushing and has a plurality of gripper assemblies which selectively engage the drill string to transfer torque to the drill string and are movable upward and downward a selected distance for drilling and reaming operations.

Each gripper assembly comprises actuating rings and jaws for engaging and dis-engaging the drill pipe. Frictional inserts with large surface areas and grooves are positioned on the jaws, allow mud and contaminate to escape under normal force and means are provided for cushioning the engagement of the inserts with the drill pipe reduce pipe surface damage. Sensing means indicate the gripped and ungripped position of the jaws and are used to indicate when a pipe joint or other impediments exist to prevent proper gripping of the pipe.

DETAILED DESCRIPTION OF THE PREFERRED EMBODIMENT

Figure 1:
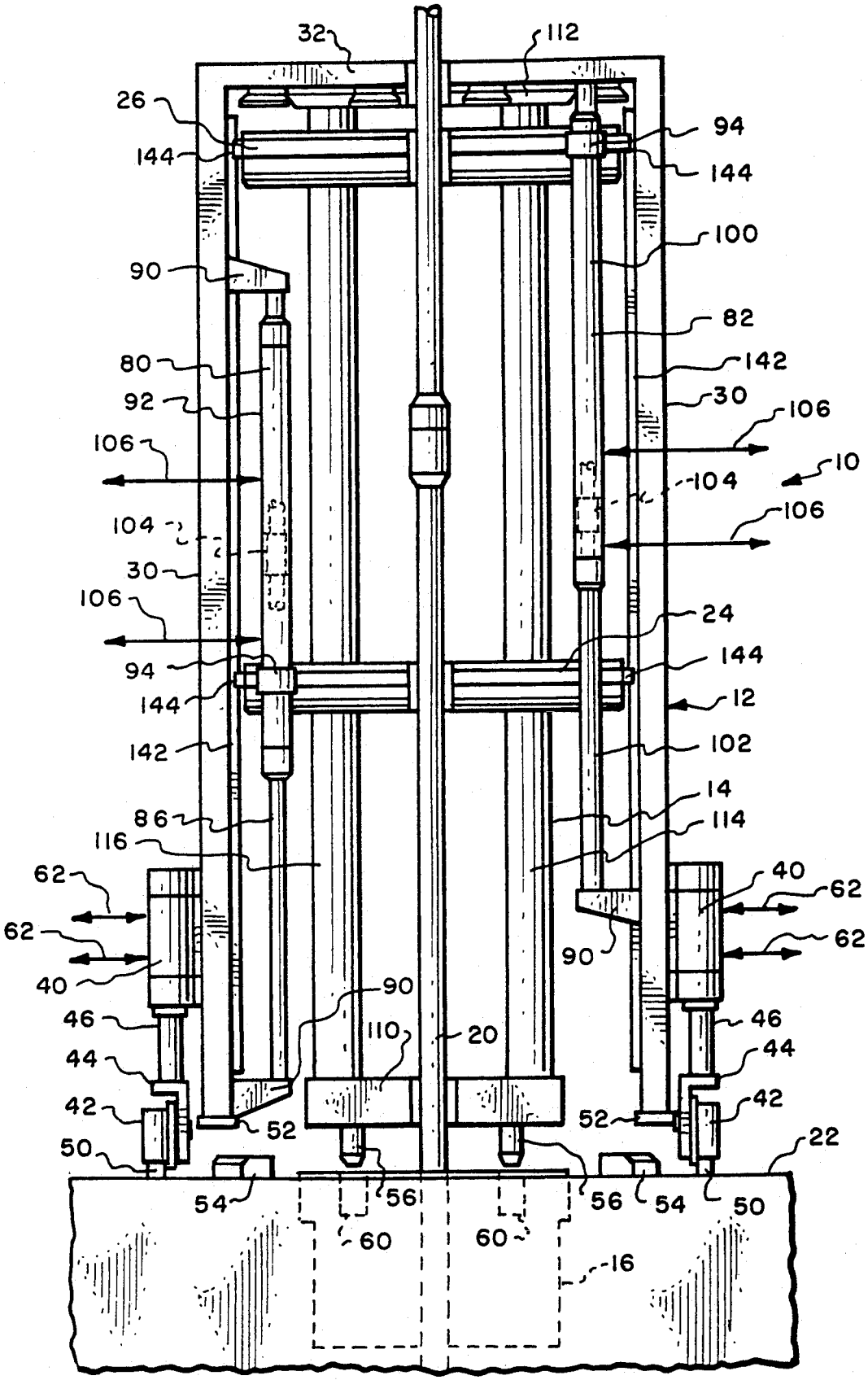
FIG. 1 is a front elevational view of the pipe drive bushing shown over a master bushing but raised from the rig floor.
Figure 2:
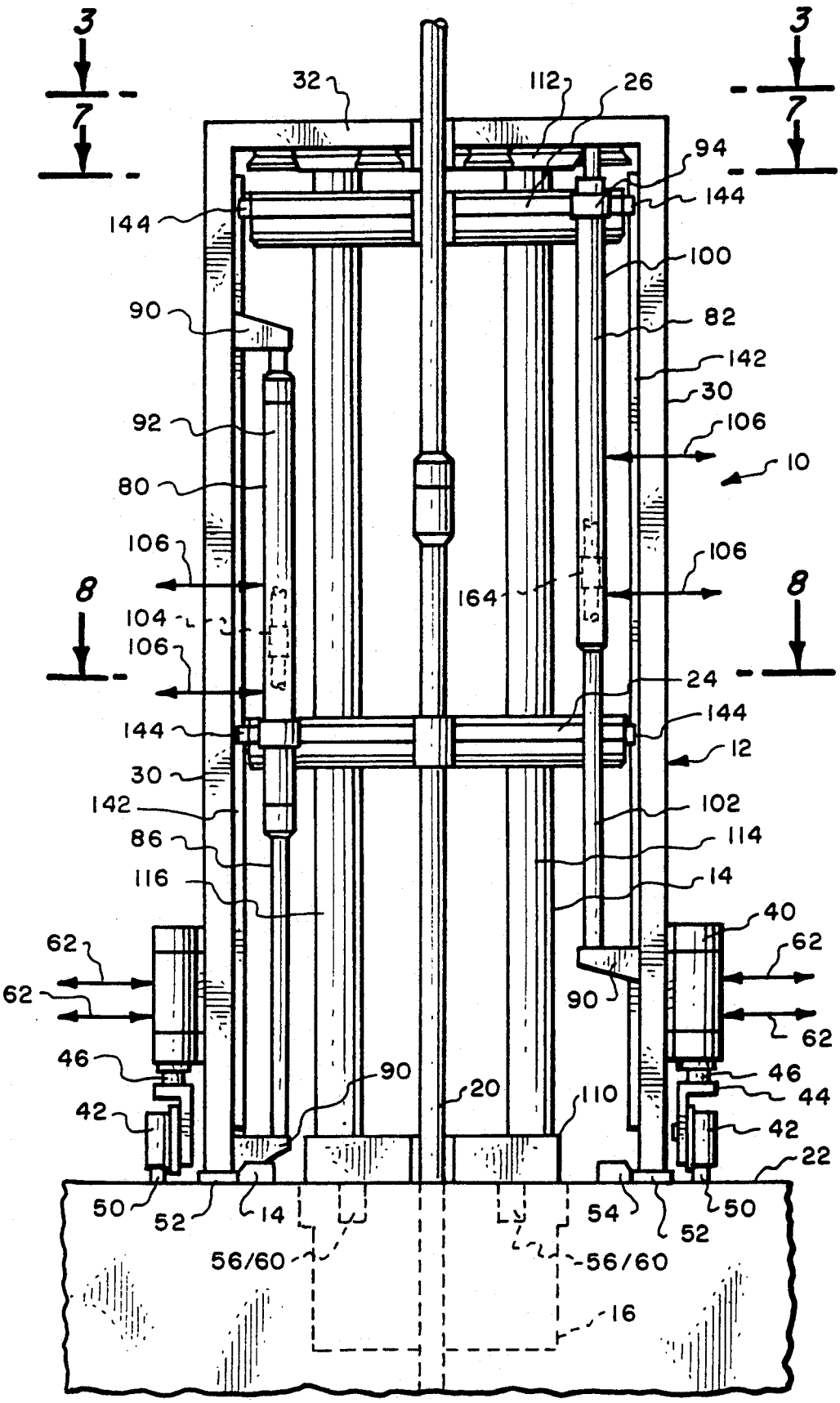
FIG. 2 is the same view as FIG. 1 but with the pipe drive bushing lowered to the rig floor for operation by the master bushing.
Figure 3:
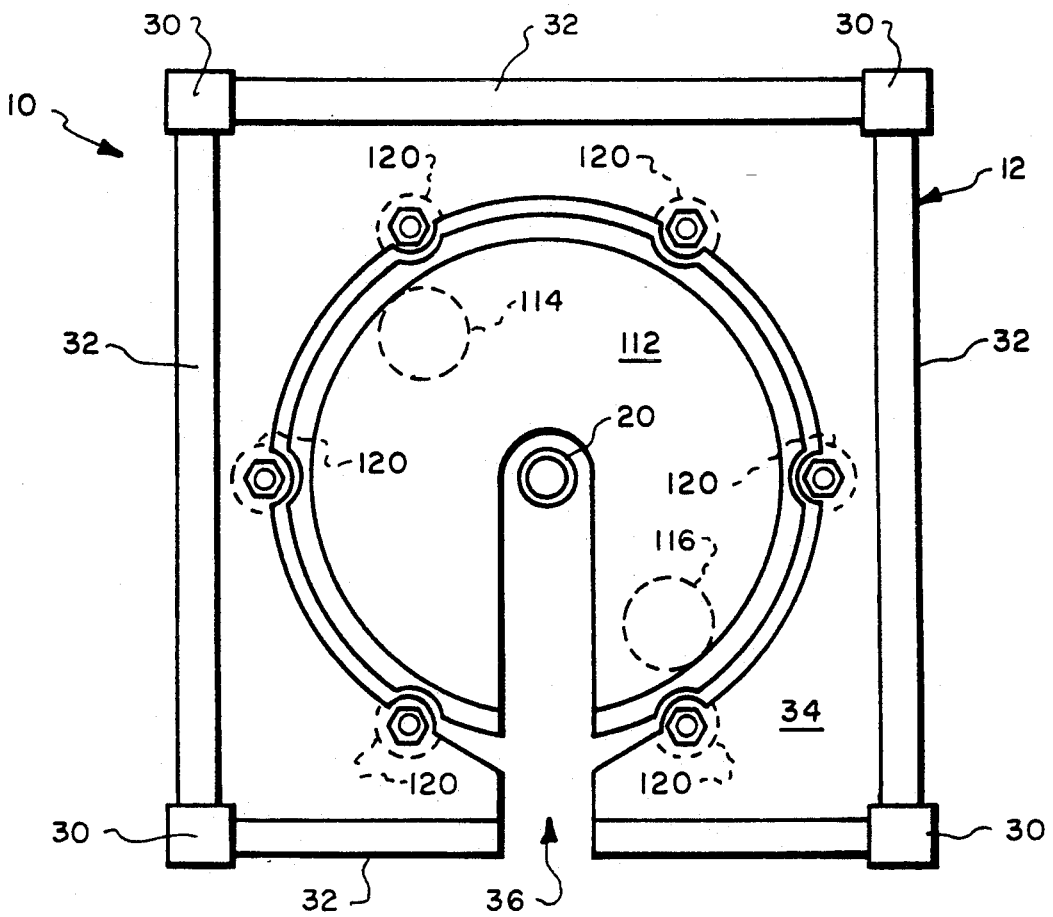
FIG. 3 is a top view of the pipe drive bushing taken along line 3—3 of FIG. 2.

In FIGS. 1, 2 and 3, it can be seen that the floor drive system of this invention comprises a pipe drive bushing 10 which includes a frame 12 enclosing and supporting a rotor 14 driven by a master bushing 16 for imparting torque to the drill pipe 20. The master bushing is shown conventionally located on the rig floor 22. The rotor 14 has two vertically movable gripper assemblies 24 and 26 for selectively gripping the drill pipe 20 as the latter moves vertically for drilling or reaming.

The frame 12 comprises four vertical frame members 30, a number of horizontal frame members 32 and an upper plate 34 and a lower plate (not shown) for stabilizing the frame 12 and rotor 14. As more clearly seen in FIG. 3, the frame 12 is provided with an opening 36 at the front to allow the pipe drive bushing 10 to be positioned over the master bushing 16 and to enclose the drill pipe 20 and to be removed during the making and breaking of the drill string and other operations attendant to rotary drilling and reaming.

Figure 7:
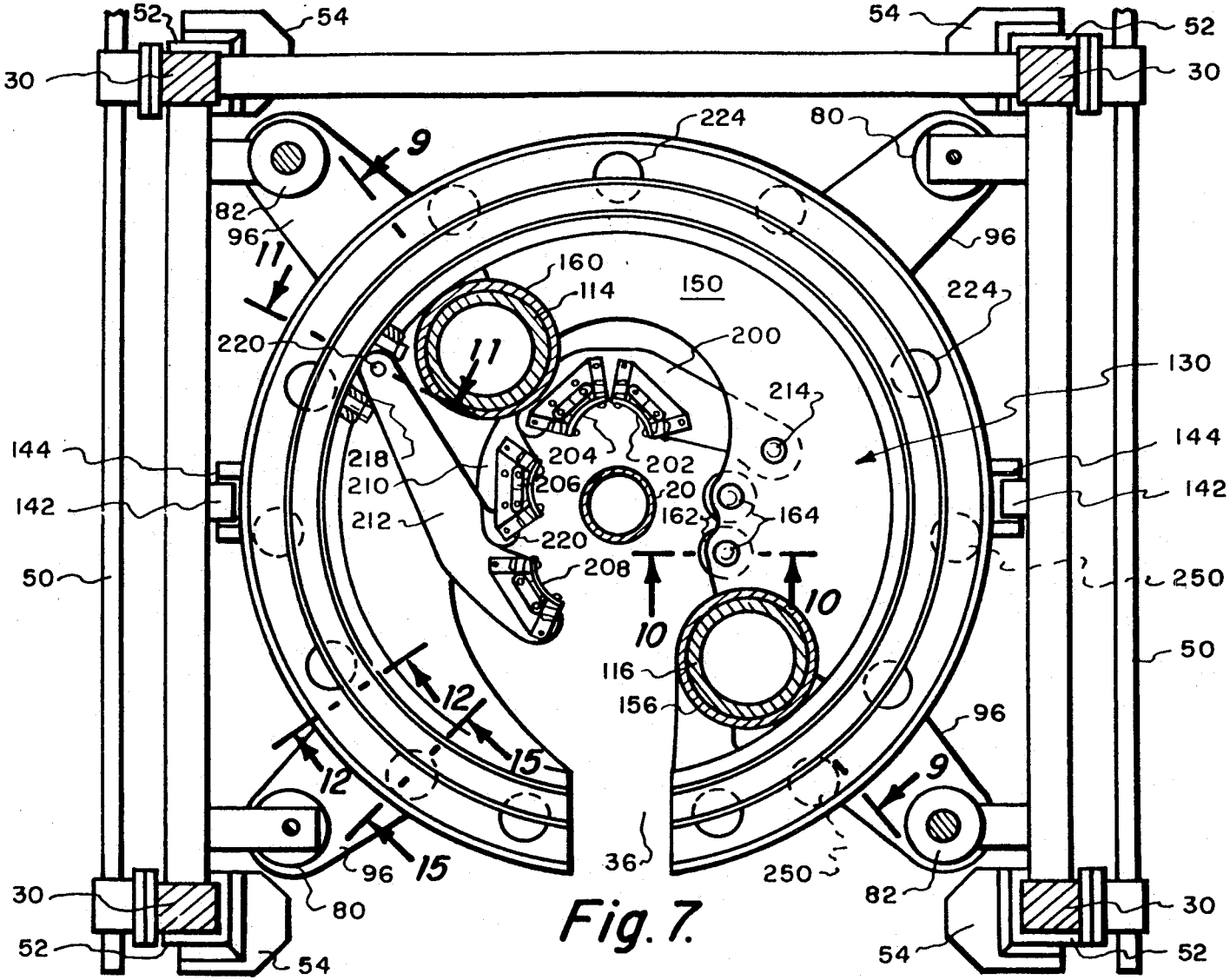
FIG. 7 is a top view of the upper gripper assembly, taken along line 7—7 of FIG. 2, showing the gripper in ungripped position with respect to the drill pipe.

The pipe drive bushing 10 is mounted for raising and lowering by four hydraulic jacking-up cylinders 40 on frame 12 with four wheels 42 positioned on suitable adapters and axles 44 on the lower ends of the cylinder rods 46. The wheels 42 are arranged to roll on a pair of rails 50 fixed to the rig floor 22. In their extended position, the pipe drive bushing 10 is movable to and away from the drill string 20 and master bushing 16 and, when positioned over the master bushing 16 and encompassing the drill string 20, the drill pipe bushing 10 is lowered to rest on the rig floor 22 by retraction of the cylinder rods 46. As shown in FIGS. 1, 2 and 7, four feet 52 on the lower end of the vertical frame members 30 and four locating bosses 54 locate the pipe drive bushing 10 in vertical alignment with the master bushing 16 and drill string 20. In this lowered position, torque transfer pins 56 on the rotor 14 are received in the recesses 60 in the master bushing 16 as clearly shown in FIG. 2.

Figure 5:
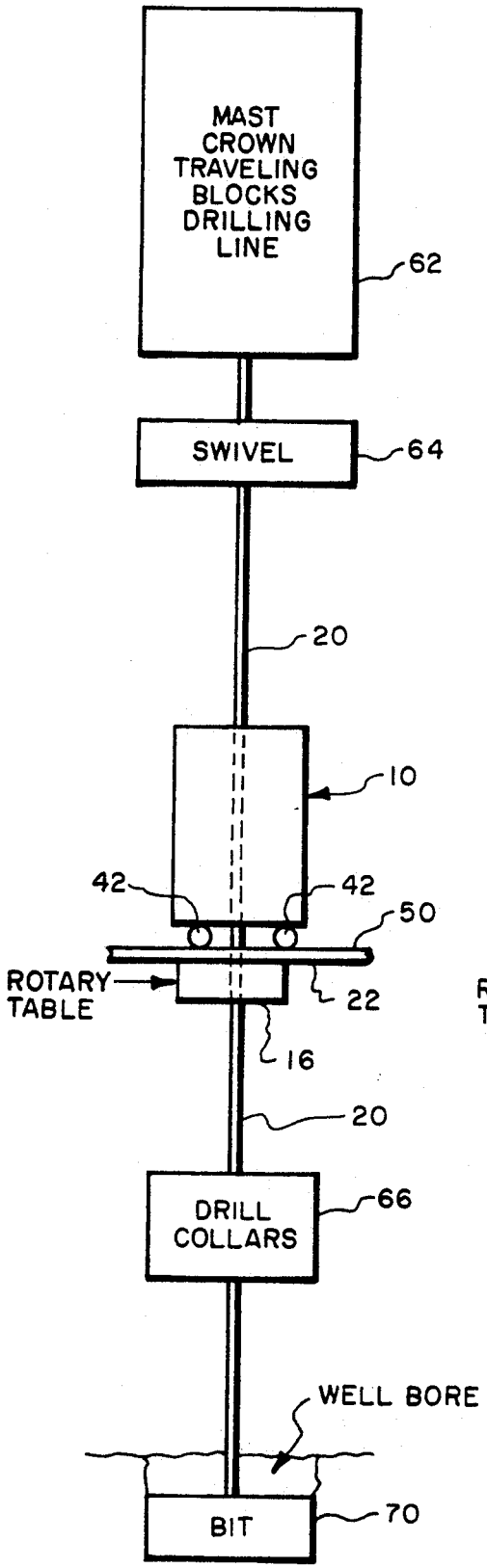
FIG. 5 is a schematic illustration of the rotary drilling system with the pipe drive bushing positioned on the rig floor and coupled to the master bushing.

FIG. 5 shows the pipe drive bushing 10 in working relationship with the master bushing and drill pipe 20 and schematically shows the mast, crown, traveling blocks, drilling line and swivel represented by block diagram 62 and 64; all normally supported by a hoist or draw works (not shown). This Figure also shows the drill pipe 20, and drill collars and bit below the rig floor 22 represented also by block diagrams 66 and 70. Other rig equipment such as the prime mover and hydraulic and pneumatic pumps to supply fluid under pressure for drilling operations, as well as the necessary valving to direct such pressure fluid to the equipment, are not shown.

Figure 6:
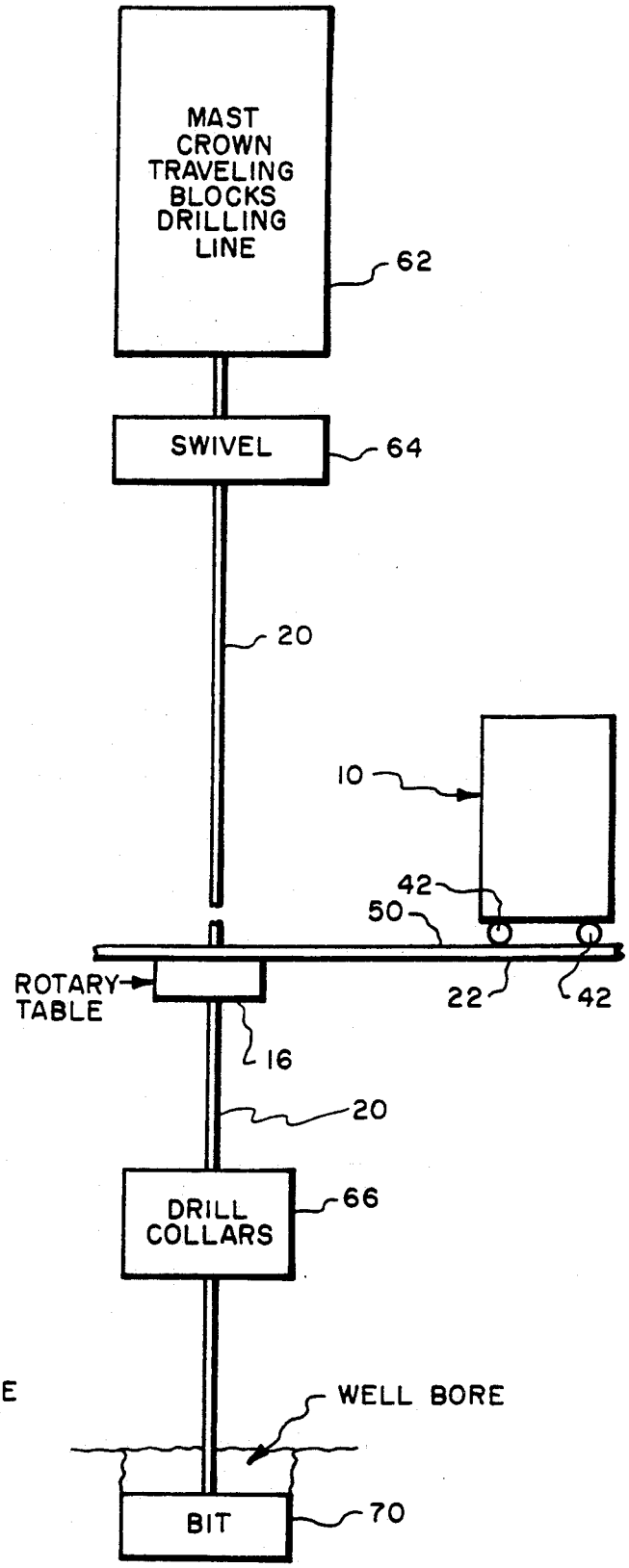
FIG. 6 is a schematic illustration of the same rotary drilling system with the pipe drive bushing raised off the rig floor and moved away from the master bushing.

FIG. 6 shows essentially the same as FIG. 5 except that the pipe drive bushing 10 has now been removed to one side to allow making and breaking of the drill string 20.

FIG. 6 also demonstrates that the pipe drive bushing 10 does not interfere with normal drilling operations if the operator desires doing so. The pipe drive bushing 10 utilizes the recesses 66 in the master bushing 16 which now can be used to receive the kelly drive bushing and kelly. Nothing has been changed at the rig floor by this invention.

The pipe drive bushing 10 also has a plurality of positioning cylinders, two cylinders 80 and 82 being shown in FIGS. 1 and 2 and a total of four shown in cross-section in FIG. 7, suitably connected to the vertical frame members 30 and to the two gripper assemblies 24 and 26 for up and down movement of the gripper assemblies. Only the two front positioning cylinders 80 and 82 will be described.

The positioning cylinder 80 for the lower gripper assembly 24 comprises a cylinder rod 86 connected at both ends by suitable brackets 90 to one frame member 30 and its cylinder 92 suitably attached by a band-type bracket 94 to the lower gripper assembly 24. FIG. 7 shows connecting arms 96 between the four positioning cylinders and the gripper assemblies. The positioning cylinder 82 for the upper gripper assembly 26 has its cylinder 100 attached to the upper gripper assembly 26 by a similar connecting arm 96 and a band type bracket 94 and its rod 102 attached to one vertical frame member 30 by bracket 90.

The upper and lower gripping assemblies 24 and 26 are moved upward and downward by their respective positioning cylinders by the selective application of hydraulic fluid into the upper and lower ends of the cylinders on each side of the reciprocating pistons 104. Hydraulic lines are represented by arrows 106.

Figure 4:
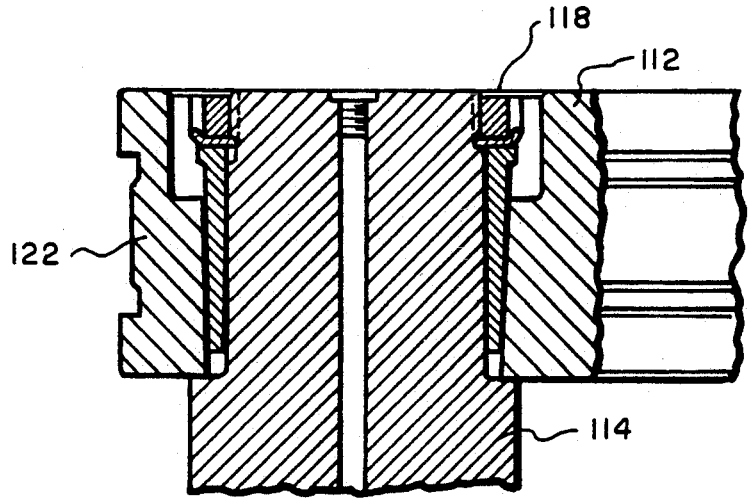
FIG. 4 is an enlarged cut-a-way of the connection between the top rotary plate and the guide post.

The rotor 14 comprises a rotatable lower plate 110 and a rotatable upper plate 112 and two vertical guide posts 114 and 116 rotatable by and with the lower and upper plates 110 and 112. FIG. 4 shows one guide post 114 suitably connected to the upper plate 112 by wedging and welding as at 118. The lower plate and the guide posts are similarly connected. The lower plate 110 has the downwardly extending torque transfer pins 56, as mentioned above, which are positionable in the master bushing 16 for the transfer of torque from the master bushing 16 through the guide posts 114 and 116 to the gripper assemblies 24 and 26.

As shown in FIGS. 3 and 4, the rotatable upper plate 112 is mounted for rotation on the frame 12 by a plurality of support rollers 120 fixed to plate 34 which engage a suitable track 122 in the upper rotary plate. Though not shown in either FIGS. 1 or 2, the lower rotary plate 110 may have similar support rollers to stabilize the rotor 14 or may simply be supported by the master bushing and rotary table bearings.

Attention is now directed to FIG. 7, et seq, for a discussion of the gripper assemblies 24 and 26.

Figure 9:
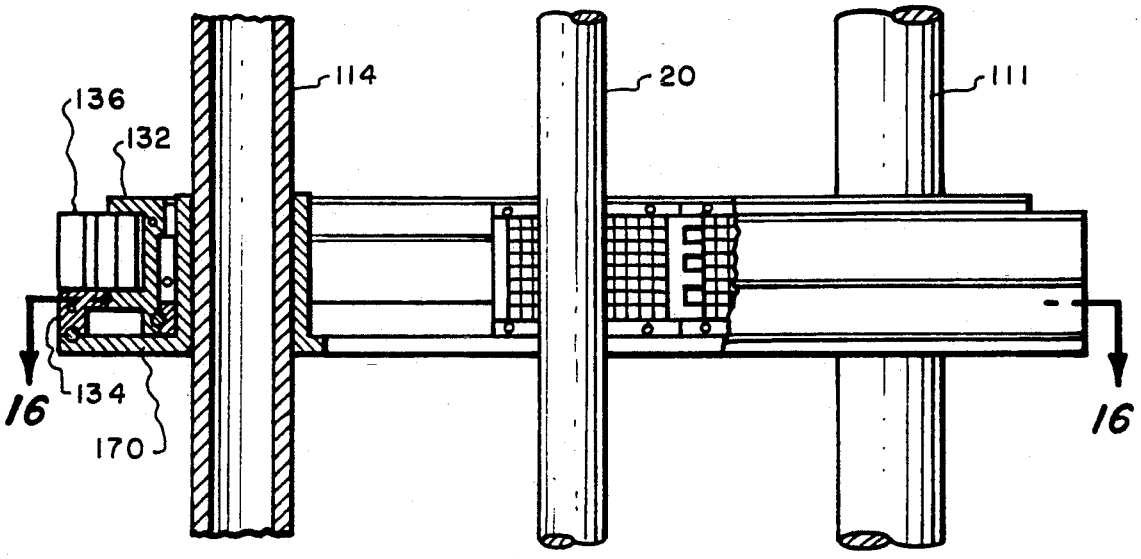
FIG. 9 is a cross-sectional view of the upper gripper assembly taken along line 9—9 of FIG. 7.

Each gripper assembly 24 and 26 comprises actuating rings and a jaw system wherein continuing rotation of certain actuating rings cause the jaw system to grip the drill pipe 20 and continuing rotation of certain actuating rings will also release the drill pipe. A gripping and un-gripping brake system provides relative rotation between the various rings for the gripping and un-gripping of the drill pipe. FIG. 9 is a partial cross-sectional view showing the drill pipe and jaws of the upper gripper assembly 26 of this invention.

Figure 8:
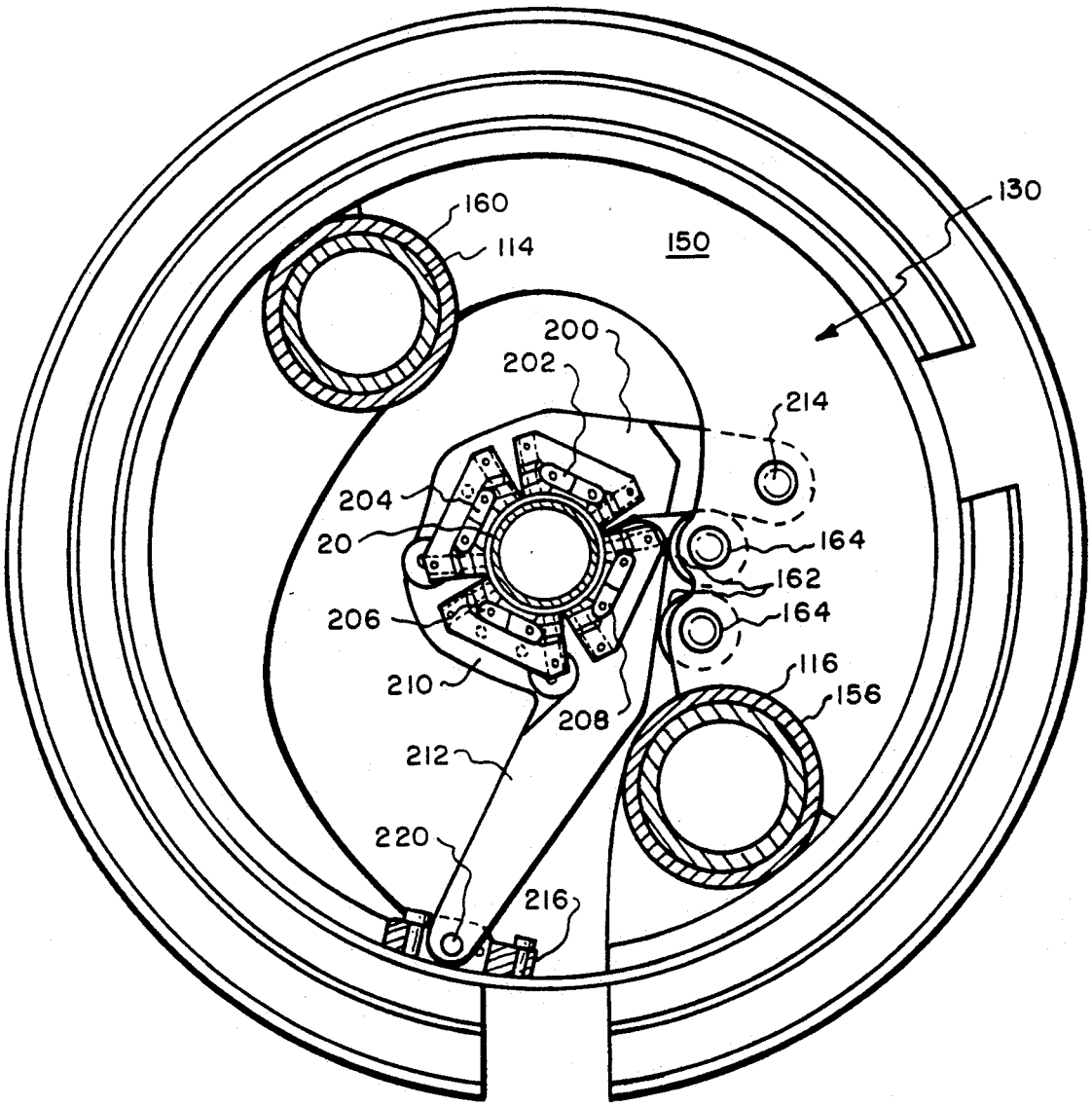
FIG. 8 is a top view of the lower gripper assembly taken along line C—C of FIG. 2, showing the grippers gripping the drill pipe.

FIG. 7 shows the jaw system of the upper gripper assembly 26 in un-gripped relationship with the drill pipe and FIG. 8 shows the lower gripper assembly 24 in an gripped relationship with the drill pipe. Since both gripper assemblies are identical, only one will be described. FIGS. 7 and 8 were chosen to show the gripping and un-gripping relationship with the drill pipe rather than attempt to show these two relationships in one gripper assembly. Also, both gripper assemblies have covers which are shown removed to expose the jaw system.

In FIG. 7, it can be seen that each gripper assembly comprises four actuating rings; an inner gripper body ring 130, a gripper ring 132, an un-gripping ring 134 and an outer brake ring 136. All rings have openings for the reception of the drill pipe and three are rotated by the guide posts 114 and 116. The brake ring 136 is held against rotation by a pair of reaction bars 144 which cooperate with forks 142 connected to the brake ring 136. The reaction bars 140 and forks 142 while preventing rotation of the brake ring 136 do allow vertical movement of the gripper assemblies by the positioning cylinders 80 and 82 or by the moving drill string. The positioning cylinders are connected to the brake ring 36 and form the connection to the described gripper assemblies.

Figure 10:
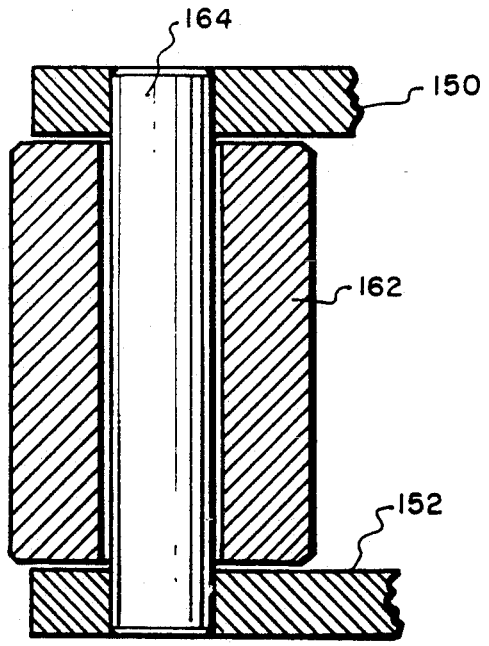
FIG. 10 is a cross-sectional view of one of the rollers of the gripper assembly taken along line 10—10 of FIG. 7.

The inner gripper body ring 130 comprises two curved upper and lower plates 150 and 152 partially covering the center of the upper body ring 130 but, defining an opening for the jaw system to operate, also forming part of the opening 36 of the system and connected, as by welding, to an outer ring flange 154. The lower cover plate 152 can be seen in FIG. 10 and in FIG. 19. The upper and lower plates 150 and 152 are welded to sleeves 156 and 160 to receive the guide posts 114 and 116 in sliding relationship. Situated between the two plates 150 and 152 are two body rollers 162, each rotatable about a pivot pin 164, one clearly shown in FIG. 10.

Figure 11:
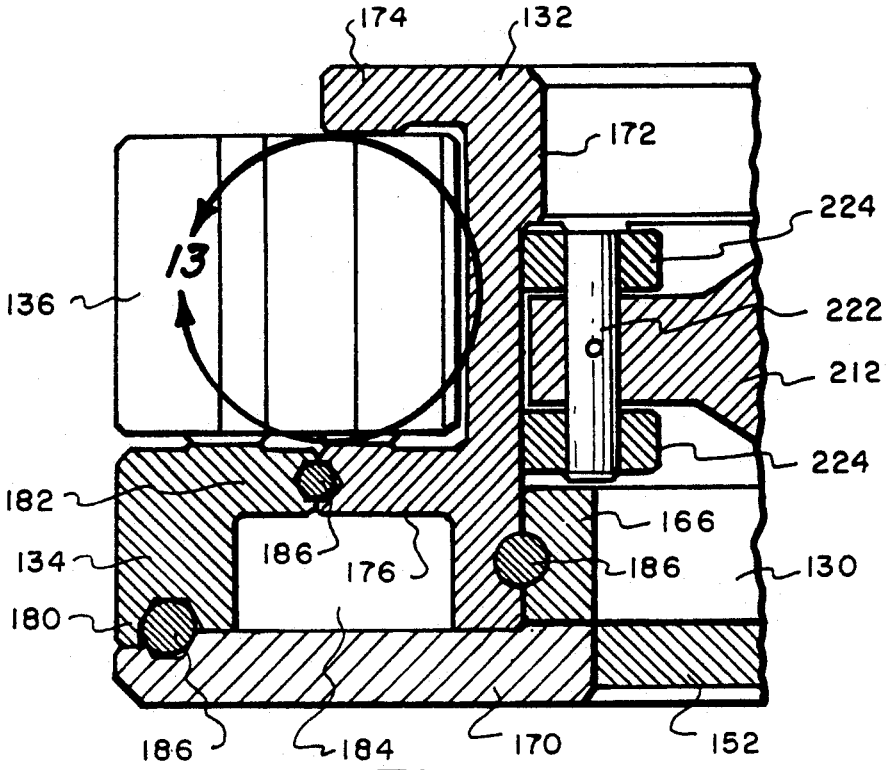
FIG. 11 is a partial cross-sectional view of the rings of the gripper assembly taken along line 11—11 of FIG. 7 to show the relationship of the actuating rings of the gripper assembly.
Figure 12:
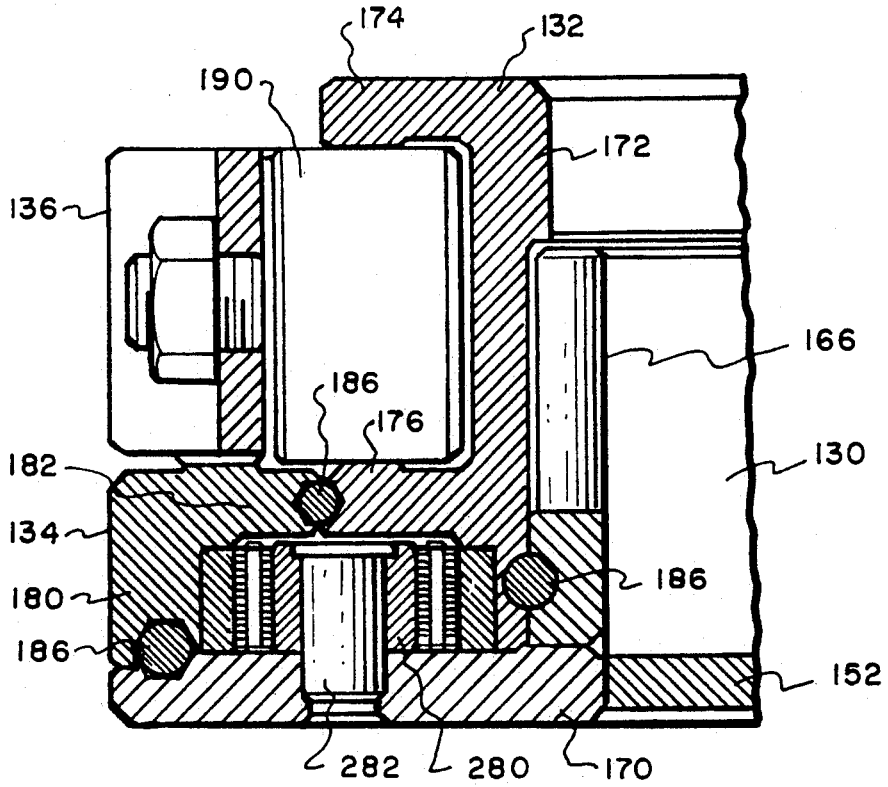
FIG. 12 is a cross-sectional view of the rings of the gripper assembly taken along line 12—12 of FIG. 7 to show the relationship of the actuating rings of the gripper assembly.

As shown in FIGS. 11 and 12, the ring flange 154 of the inner body ring 130 has a vertical wall 166 and a horizontal ledge 170 extending radially from wall 166 which supports the gripper ring 132, the un-gripper ring 134 and the brake ring 136. FIGS. 11 and 12 also show the cross-sectional configuration of the gripper ring 132 and ungripper 134 ring and brake ring 136. The gripper ring 132 has a vertical wall 172 which engages the vertical wall 166 of the gripper body ring 130 and has two spaced apart radially outwardly extending flanges 174 and 176 to partially enclose the brake ring 136. Wall 172 extends from above the inner body ring 130 to the ledge 170. The ungripper ring 134 has a vertical wall 180 and a radially inwardly extending flange 182 which together with the ledge 170 defines a channel 184 with the ledge 170. Channel 184 is more clearly seen in FIGS. 17 and 18.

Since there is relative rotation between the body ring 130, the gripper ring 132 and the braking ring 134, suitable bearing material 186 of molybdemum disulfide filled nylon is placed between the rings, where necessary. Also, since the brake ring 136 is held non-rotatable, a plurality of rollers 190 journaled to the brake ring are used between the brake ring 136 and the gripper ring 132 to reduce friction between the brake ring and the gripper ring 132.

Turning back to FIG. 7, it can be seen that the jaw assembly comprises an anchored arm 200, four grippers 202–208, a connecting ring 210 and a leading arm 212. Two grippers 202, 204 are located on the anchored arm 200. One gripper 206 is located on a connecting link 210 and the other gripper 208 is located on the leading arm 212.

The anchored arm 200 is pivotally connected at one end by an anchor pin 214 fixed between the two plates 150 and 152 and pivotally connected at its other end at 216 to the connecting link 210. The other end of the connecting link 210 is pivotally connected at 218 to the leading arm 212 between its gripper 208 and a pivotal connection 220 to the gripper ring 132.

As shown in FIG. 11, the pivotal connection 216 of the leading arm 212 comprises a pin 222 between two brackets 224 connected to the wall 172 of the gripper ring 132.

Taking FIGS. 7 and 8 together, it can be seen that rotation of the inner gripper body ring 130 retardation of the gripper ring 132 causes the four grippers 202–208 to grip the drill pipe 20 with the leading arm 200 in camming relationship with the two body rollers 162. Actually, torque is transferred to the jaw system by the guide posts 114 and 116 to the gripper body ring 130 and to the anchor pin 214 which pulls the anchored arm creating the effect of the hinged jaws of a pipe tong.

Figure 13:
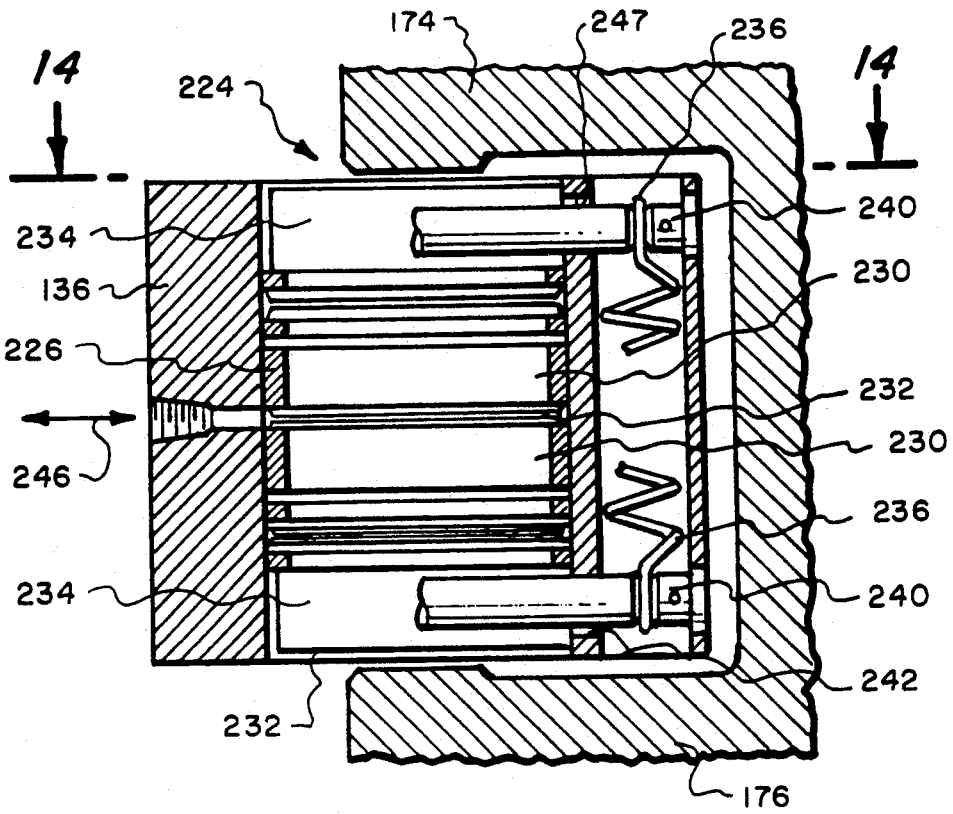
FIG. 13 is a cross-sectional view of the gripping brake as shown encircled at 13 in FIG. 11.

The relative rotation of the inner body ring 130 and the gripper ring 132 is accomplished by the actuation of a plurality of gripper brakes 224 shown in FIG. 13.

Figure 14:
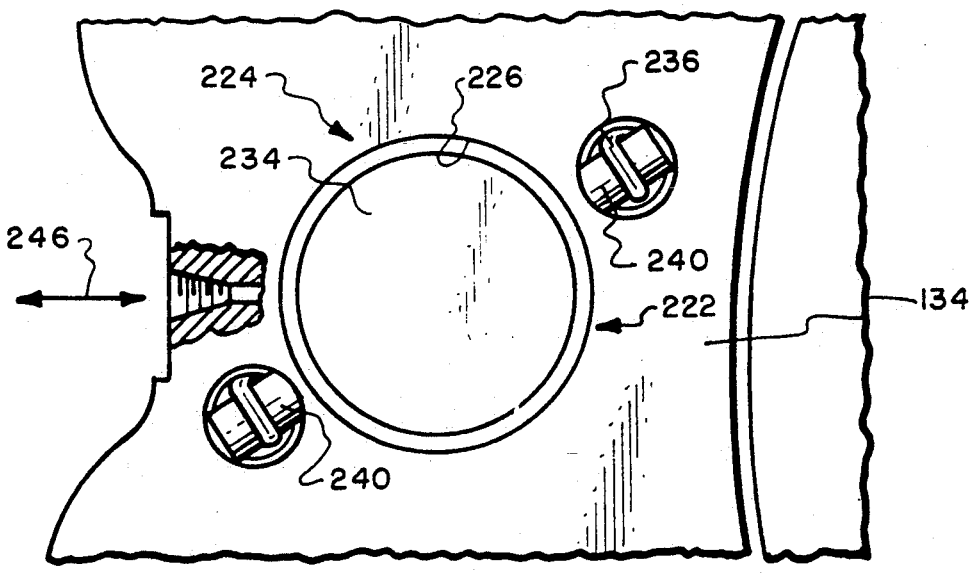
FIG. 14 is a top view of the gripping brake taken along line 14—14 of FIG. 13.

The gripper brake 224 of FIGS. 13 and 14 is located in a suitable cylindrical cavity 226 in the brake ring 136 and comprises a pair of oppositely acting brake pistons 230 which define a cavity 232. Oppositely acting brake pads 234 are held deactivated by springs 236 and longitudinal pins 240 in each pad. The spring end pins 240 are allowed to move vertically by slots 242. Upon the introduction of pressurized hydraulic fluid in the cavity 232, the pistons 230 are driven into engagement with the oppositely acting brake pads 234 which are forced into engagement with the flanges 174 and 176 of gripper ring 132. The arrow 246 represents the hydraulic pipe line to the cavity 232.

From the foregoing it can be seen that the gripper brakes 224 provide relative rotation between the gripper body ring 130 and the gripper ring 132 so that the jaws grip the drill pipe.

Figure 15:
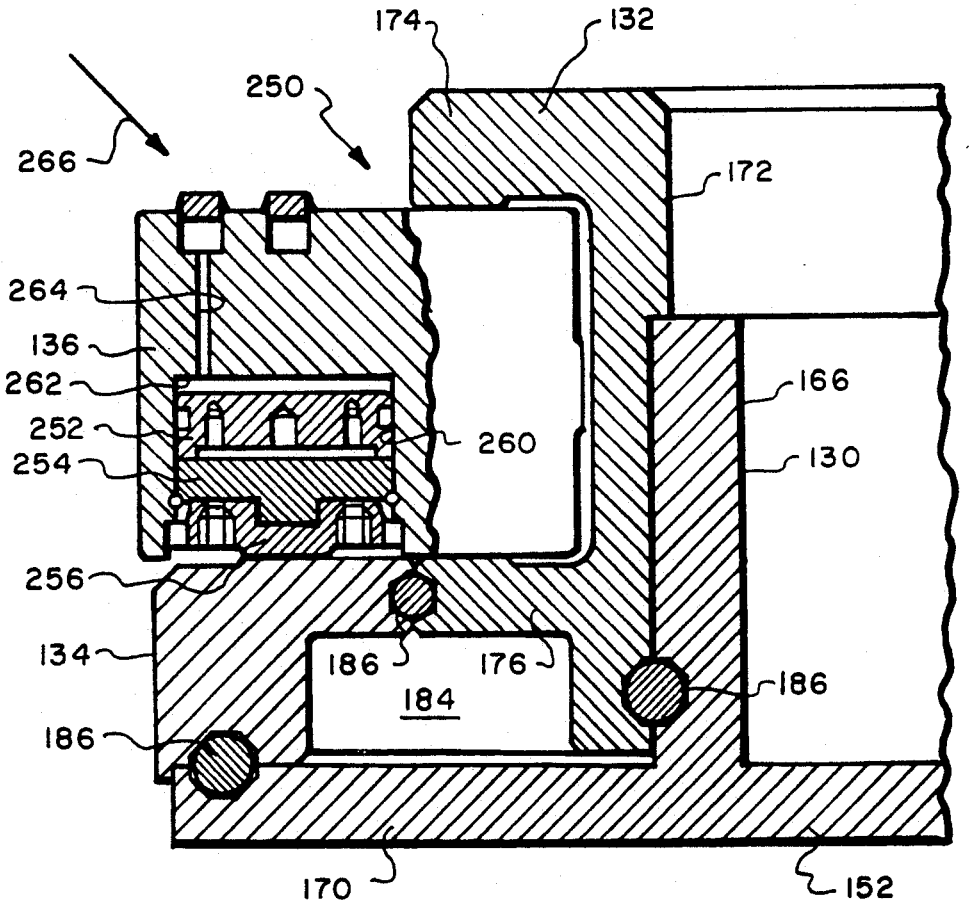
FIG. 15 is a cross-sectional view of an un-gripping brake taken along line 15—15 of FIG. 7.

To operate the ungripper ring 134, the brake ring 136 is provided with a plurality of ungripper brakes 250 which engage the brake ring 136 and the ungripper ring 134. One ungripper brake 250 is shown in FIG. 15 and comprises a single brake piston 252, a spacer ring 254 and a wear pad 256 which is attached to the spacer ring 254, all within a bore 260 in the brake ring 136. The bore 260 is sufficiently deep to provide a piston chamber 262. Fluid under pressure is introduced into the piston chamber 262 through passage 264 to move the wear pad 256 into engagement with the ungripper ring 134 which retards the rotation of the ungripper brake causing a slowing of the ungripper ring. Arrow 266 represents the hydraulic line to the passage 264.

Figure 16:
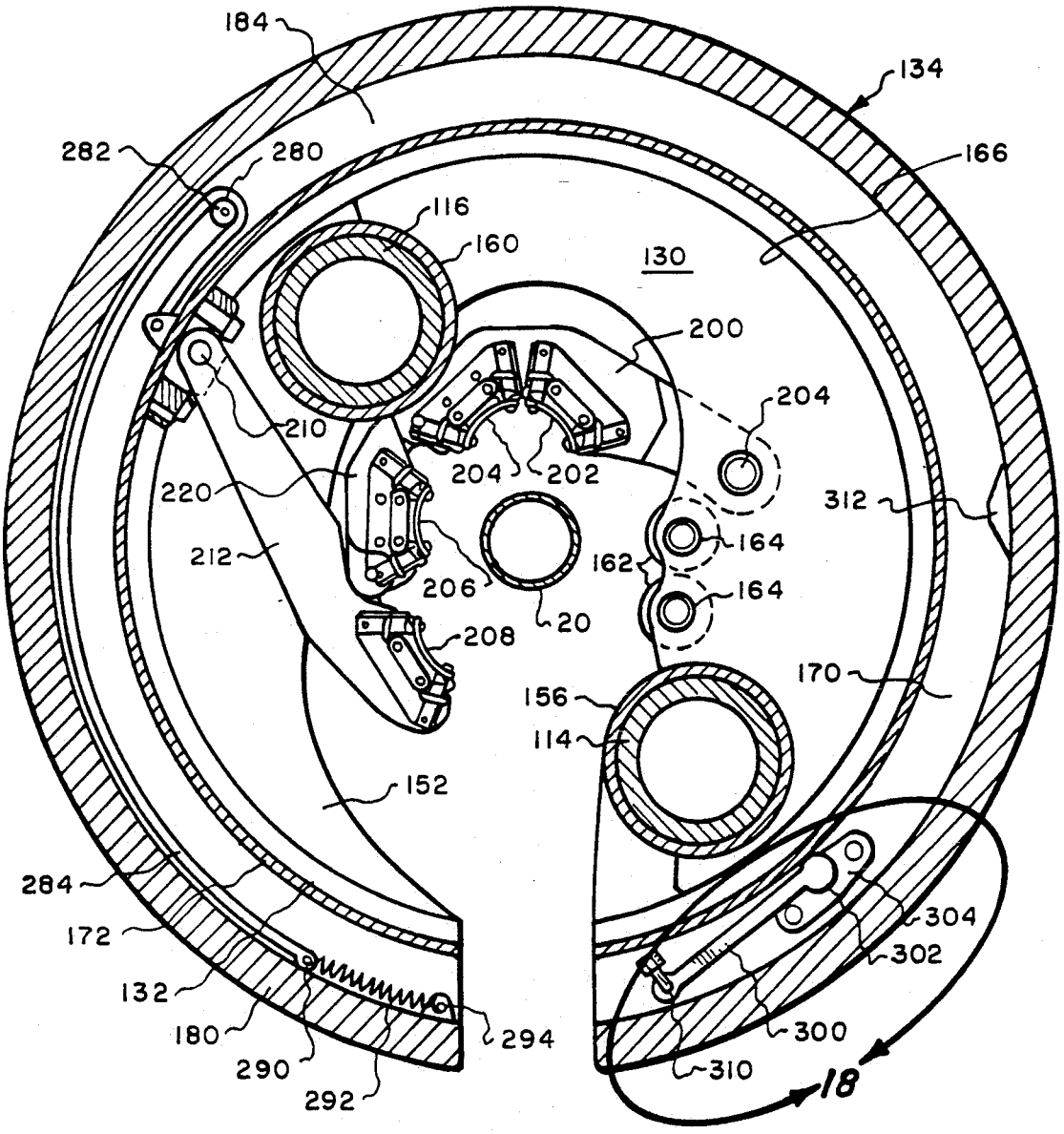
FIG. 16 is a top cross-sectional view of the rings of the gripper assembly taken along line 16—16 of FIG. 9.
Figure 17:
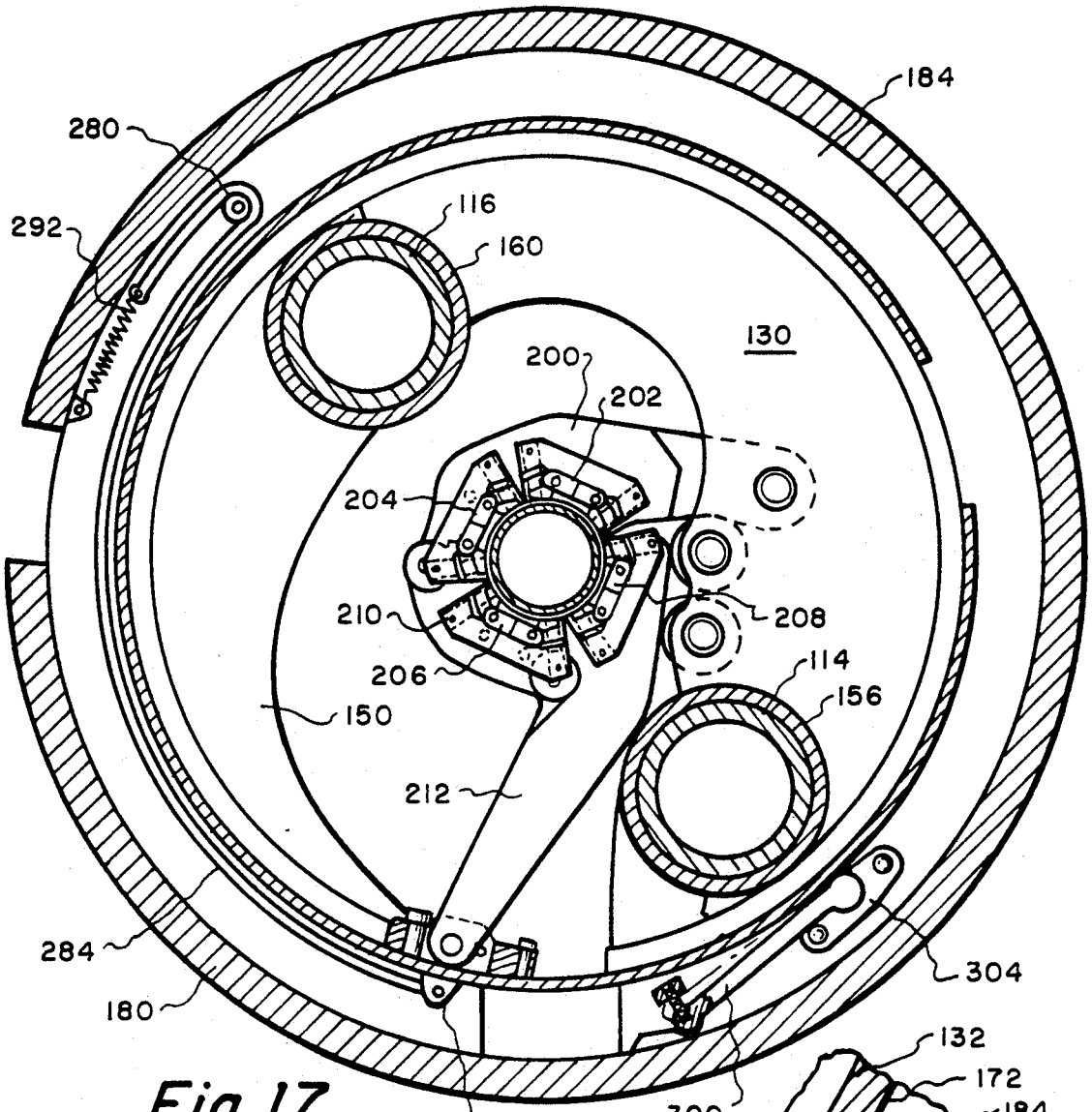
FIG. 17 is a view similar to FIG. 16 but showing the grippers engaging the drill pipe.
Figure 18:
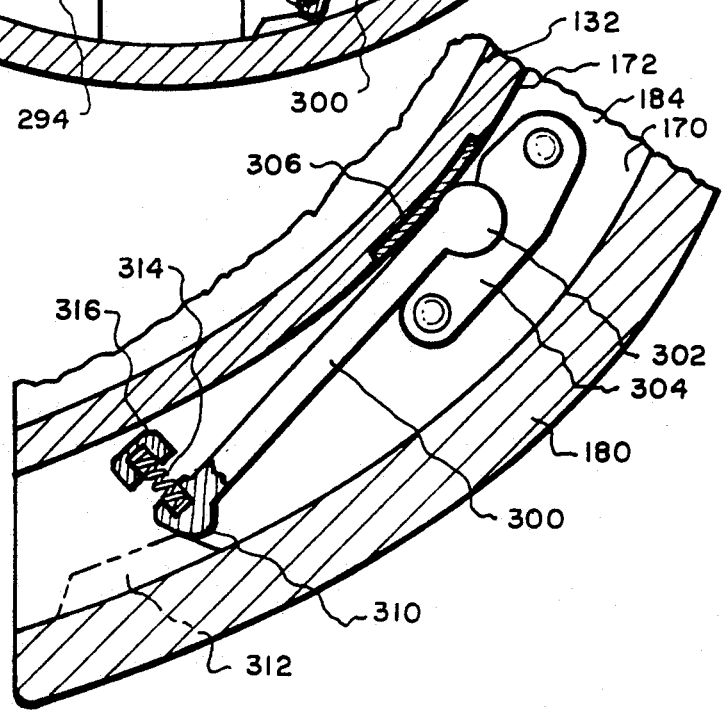
FIG. 18 is an enlarged view of the latch as shown in FIGS. 16 and 17 encircled at 8 in FIG. 16.

FIGS. 16 and 17 are cross-sectional views of the upper gripper assembly and show the previously mentioned channel 184 (see FIGS. 11 and 12) in the gripper assembly 26. A reverse roller 280 is shown within this channel 184 and attached to the ledge 170 of the inner gripper body plate 130 by a pivot pin 282. A chain 284 is pivotally connected at one end to the wall 172 of the gripper ring 132 adjacent the pivot 220. The chain 284 encircles up and around the reverse roller 280 and is attached at its other end to one end 290 of a coil spring 292. The other end 294 of the coil spring 292 is attached to the wall 180 of the ungripper ring 134 adjacent the opening for the reception of the drill pipe.

On the opposite side of the opening for the reception of the drill pipe, and within the channel 184 is a latch arm 300 having an eccentric cam 302 held against a bearing pad 304 on wall 172 in the gripper ring 132 by a bearing bracket 306. This latch arm 300 is provided with a second cam surface 310 at its other end and is spring loaded by a coil spring 314 and head 316 to insure that the head 310 engages a cam 312 on the ungripper ring when the latter rotates relative to the brake ring. The latch arm is provided with sufficient freedom of movement to provide the camming action of this latch arm.

When the gripper ring is slowed by actuation of the brakes, this gripper ring moves relatively counter clockwise to the rotation of the gripper body ring simultaneously pulling the ungripping ring clockwise with the chain pulling on the reverse roller. To reverse the rotation of the gripper ring, the reverse roller and rotation between the gripper ring and the brake ring move in opposite directions depending upon which brake is energized.

After the grippers have gripped the pipe, in one gripper assembly, and a second gripper is released from the pipe, torque from the rotary goes to the gripping one creating reaction on the leading arm. This reaction is taken up by the latch preventing the arm from opening the gripper. Rotation of the gripper ring counter clockwise forces the latch open against the spring on the opposite end of the camming surface. The ungripper ring being pulled by the chain rotates clockwise. When rotation stops, the cam on the ungripper ring is just past the actuating knob on the latch and the spring forces the latch to rotate and jam the gripper ring preventing clockwise rotation.

To ungrip the gripper assembly, the brakes are applied to the ungripper ring which makes it rotate counter clockwise pulling the chain through the spring. The cam on the ungripper ring opens the latch making possible counter clockwise rotation of the gripper ring.

From the foregoing it can be seen that in normal operation, the master bushing rotates rotor 14 and the gripper assemblies clockwise. When the jaws are engaged with the pipe, torque is transferred to the drill pipe. All the elements of the gripper assembly are rotated with the same velocity except of course the brake ring. When a brake is applied to one of the rotatable rings, its rotating velocity slows down creating a relative rotation to the gripper body ring which continues to rotate with the rotor. This relative rotation is used for gripping and ungripping operation. All mechanical events in the gripper assemblies occurs during continuous rotation and no external forces except for brakes activation are involved.

Figure 19:
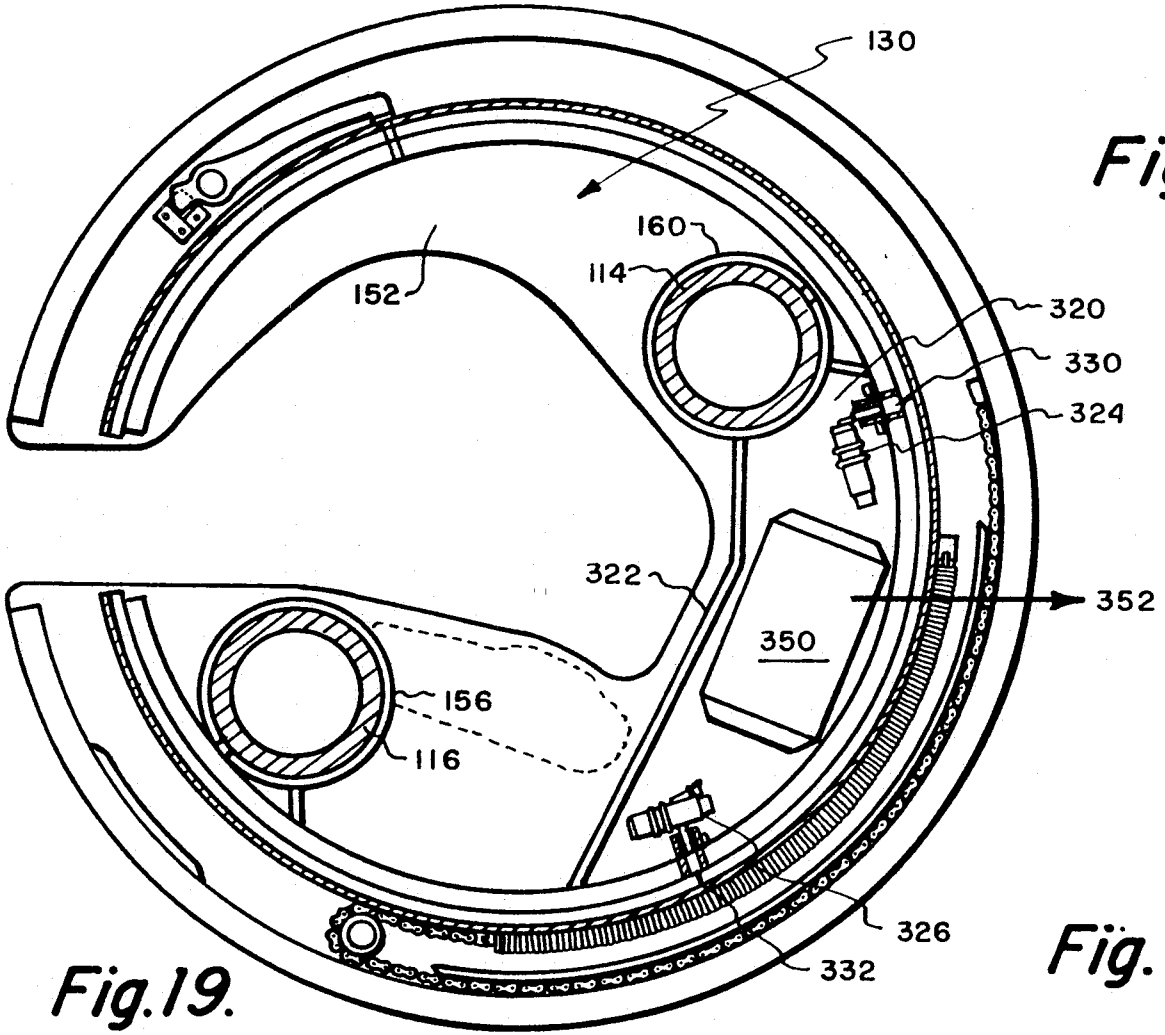
FIG. 19 is a top cross-sectional view similar to FIG. 16 and 17 but with the gripper assembly omitted to show the limit switches and actuators to indicate when the jaws are in gripped or ungripped position.

To sense the position of the jaws, either closed or open, there are a number of sensing means which may be utilized. The following description involves limit switches and limit switch actuators although proximity switches would perform equally as well. It will also be apparent that the plan view of FIG. 19 shows the chain 284, spring 292 and reverse roller 280 opposite from that shown in FIG. 16. FIG. 16 is more of a schematic of the chain and latch while FIG. 19 depicts these items more appropriately located.

FIGS. 19–22 show the lower plate 152 as having a compartment 320 formed by a wall 322 enclosing conventional limit switches 324 and 326 and conventional limit switch actuators 330 and 332 to sense the gripping (closed) and ungripping (open) position of the grippers. Switch 324 is the fully open position sensor and switch 326 is the fully closed position sensor. The limit switch 324 for the grip open position is adjacent the sleeve 160 and its limit switch actuator 330 is located horizontally in the vertical wall 166 of the gripper body ring 130. This limit switch actuator 330 is a spring biased plunger 334 which contacts the limit switch 324 when the grippers are between the opened and closed position and become disengaged from the switch 324 by entering a cam 336 in the wall 166 of the gripper body ring 130 when the grippers are in fully ungripped position.

Figure 20:
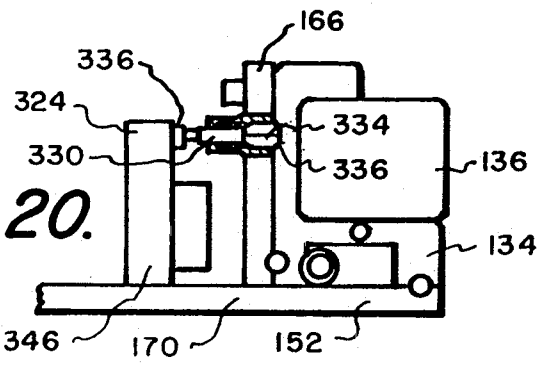
FIG. 20 is a cross-sectional view of the actuating ring and the position of the limit switch actuator.
Figure 21:
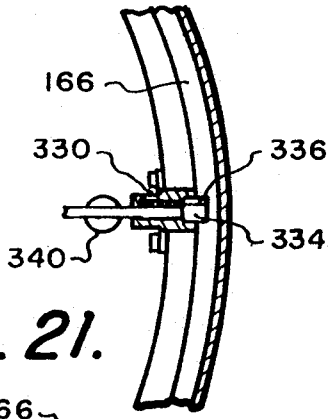
FIG. 21 is an enlarged view of the limit switch actuator relative to the vertical wall of the actuator rings.
Figure 22:
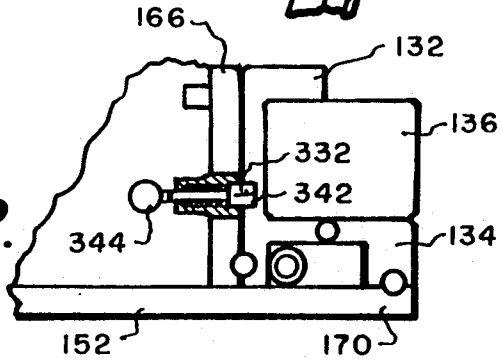
FIG. 22 is a cross-sectional view similar to FIG. 20 and showing the position of another limit switch actuator.

FIG. 21 illustrates the plunger 334 within the cam 336 and also show the contacting means 340 for engaging the switch 324. FIG. 21 shows the plunger 334 within a cam 336 in the wall 166 and also shows the contacting means 340 for engaging the switch when the plunger is not within the cam. FIG. 22 shows the switch actuator 332 also mounted in wall 166 and within a cam 342 when the switch contacting means 344 is out of engagement with the limit switch 326. Switch 324 and actuator 330 are located higher on the wall 166 than limit switch 326 and its actuator 332 to prevent interference during rotation of the actuating rings. Limit switch 324 is supported on a bracket 346 as shown in FIG. 20.

Figure 23:
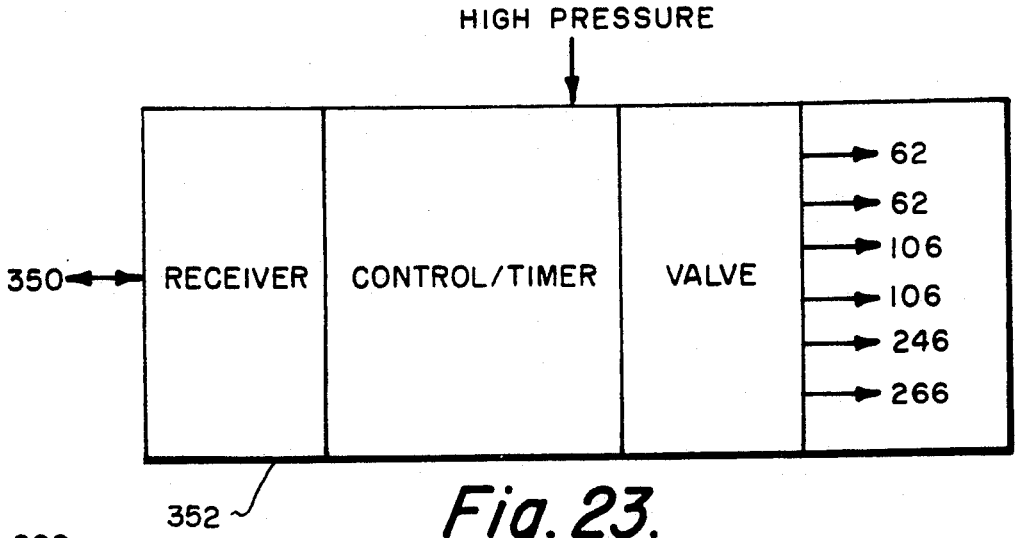
FIG. 23 is a schematic illustration block diagram illustrating the receiver control and timer for the valve to direct the flow of high pressure to the various pressure responsive devices.

The two limit switches are connected to a radio transmitter 350 to send the appropriate signals to a receiver controller 352 (FIG. 23).

The two limit switches 324 and 326 are spaced apart to identify the fully open or fully closed position. The time lapse between the fully open and fully close position is a function of the velocity of the rotation of the respective gripper assembly. When the fully open time is known, then the timing of the fully closed can be anticipated. If the switch for the fully closed position is not activated within the expected time, this is an identification that the grippers are engaging a pipe joint or some other obstacle and a signal can be sent to the controller 352 to activate the positioning cylinders 80 and 82 to raise or lower the particular gripper assembly so that the pipe and then the grip and the jaws reach their fully closed position. The brake mechanism will of course be applied to hold the respective jaws so that the gripper assembly may be moved.

FIG. 23 schematically shows the receiver controller 352 and a timer to receive the signals from the radio 350 and to time the opening and closing of the grippers and to identify whether or not a joint or other obstacle has been gripped. The figure also shows a valve means for actuating the various hydraulic pressure devices.

The function of the positioning cylinders and the gripper assemblies 24 and 26 for rotary drilling and reaming will now be described.

As mentioned before, the upper and lower gripper assemblies 24 and 26 are moved upward and downward by operation of the positioning cylinders 80 and 82 in the selective application of hydraulic fluid into the upper and lower ends of the cylinders on each side of the pistons 104. In the upper and downward movement, the gripper assemblies 24 and 26 do not take any vertical load but only follow the moving drill string suspended on the rig hoist equipment.

In a lowering mode of operation for drilling, lower gripper assembly 24 will engage the drill string 20 in its uppermost position and will travel downward to its lowermost position to lower the drill string 20 into the well bore. While lower gripper assembly 24 is in its lowermost position, the upper gripper assembly 26 will be in its uppermost position and will grip the drill string 20. Lower gripper assembly 24 will release the drill string 20 when the upper gripper assembly 26 has gripped the drill string 20. Upper gripper assembly 26 will travel from its uppermost position to its lowermost position while gripping the drill string 20. Meanwhile, the lower gripper assembly 24 will travel from its lowermost position to its uppermost position, all the while out of engagement with the drill string 20. When upper gripper assembly 26 is at its lowermost position, the lower gripper assembly 24 will grip the drill string 20 and the upper gripper assembly 26 will release the drill string 20. Then, the lower gripper assembly 24 will move from its uppermost position to its lowermost position while maintaining gripping engagement with the drill string 20. This process will continue for as long as the rig operator desires.

During the raising mode of operation for reaming, the upper gripper assembly 26 while in its lower most position will grip the drill string 20 and then travel upwardly to the uppermost position. Before the upper gripper assembly 26 releases from the drill string 20, the lower gripper assembly 24 will travel to its lowermost position and grip the drill string 20. Then, the lower gripper assembly 24 will move to its uppermost position, while the upper gripper assembly 26 is traveling downward to its lowermost position. Upper gripper assembly 26 will then grip the drill string 20 and the lower gripper assembly 24 will then release the drill string 20 while the upper gripper assembly 26 is gripping the drill string 20 and moving from its lowermost position to its uppermost position, the lower gripper assembly 24 is not gripping the drill string 20 and will move to its lowermost position. This process continues for as long as the rig operator desires.

Figure 24:
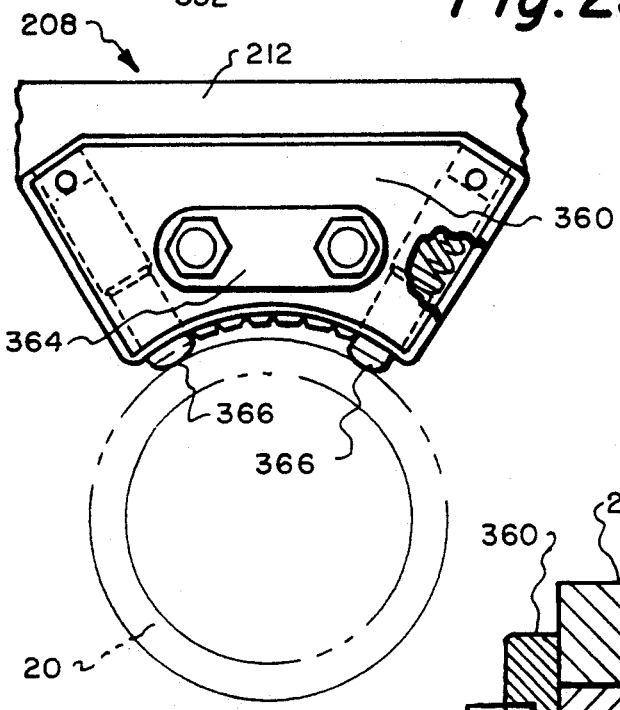
FIG. 24 is a top view of one of the grippers about to engage the drill pipe.
Figure 25:
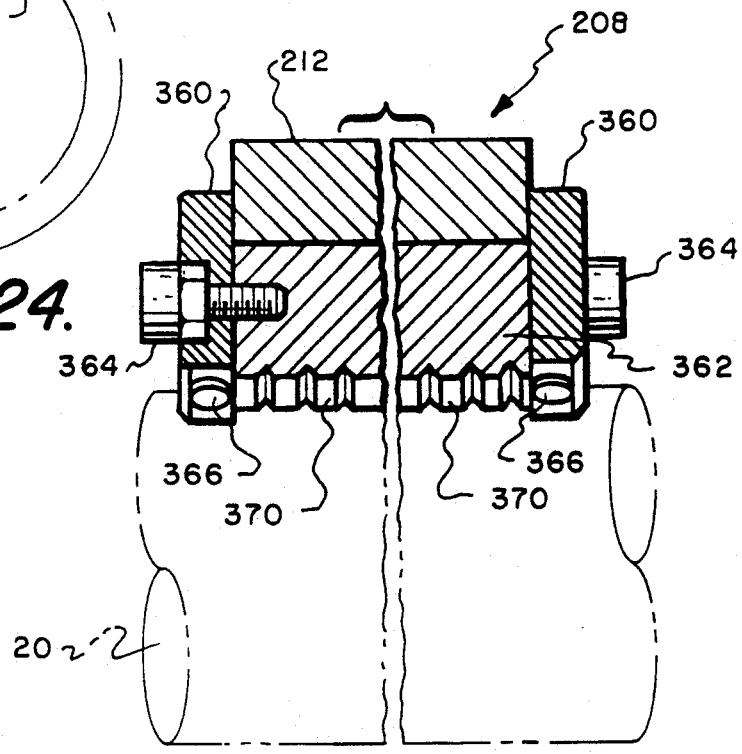
FIG. 25 is a side view of the gripper of FIG. 24.

Finally, another important feature of this invention is the improvement in the grippers themselves and attention is now directed to FIGS. 24 and 25 where one gripper, such as 208, is shown beginning to engage the drill pipe 20. This gripper 208 includes a pair of holding plates 360 for a friction insert 362. The holding plates 360 are bolted to the friction insert 362 and to the leading arm 212 by a pair of bolt brackets 364. At each end of the holding plates 360 and disposed to engage the drill pipe radially are spring actuated pistons 366 which extend radially inwardly beyond the friction insert 362 in such a manner that the pistons 366 will engage the drill pipe first as the gripper is moved into contact with the drill pipe. These pistons 366 cushion the movement of the friction insert as the latter is moved into engagement with the drill pipe to reduce the possibility of damage to the drill pipe. The insert has a large surface area with large grooves 370 to permit mud and other contamination to escape under normal force.

It should be understood that wherever hydraulic fluid was referred to, pneumatic fluid would also be feasible, and while drill pipe is continuously referred to above, this invention may be used to rotate casing particularly in the process of cementing.

I claim:

1. In a system for drilling oil and gas wells and having a string of drill pipe for drilling and reaming, a rig with a master bushing located at the rig floor through which drilling and reaming operations may be conducted and having a rotary table for driving said master bushing, the improvement comprising:

a floor drive system for applying torque to said drill pipe at the rig floor and adapted to be releasably coupled to said master bushing and including at least a pair of gripper means for gripping said drill pipe while powered by said master bushing, and means for selectively and sequentially raising and lowering each said gripper means for selectively gripping and releasing said drill pipe as said gripper means travel a selected distance in said floor drive system as said drill pipe is being raised or lowered for drilling or reaming.

2. The system as claimed in claim 1 including a frame and a rotor within said frame for receiving said drill pipe, said rotor containing said gripper means and also having means for releasably coupling said floor drive system to said master bushing.

3. The system as claimed in claim 2 including means for raising said frame and rotor off the rig floor thereby disconnecting said rotor from said master bushing so that said frame and motor may be moved along the rig floor and away from said master bushing and for lowering said frame and rotor onto said master bushing to connect said rotor to said master bushing so that said master bushing may impart torque to said rotor.

4. The system as claimed in claim 3 wherein said rotor includes post means connected to each said gripper means and extending substantially from said master bushing when said rotor is coupled thereto and substantially to the top of said frame for imparting torque to said gripper means as they travel upwardly and downwardly said selected distance.

5. The system as claimed in claim 4 wherein said gripper means are continuously rotated by said post means and wherein braking means selectively reduce rotation of parts of said gripper means to cause other parts of said gripper means to grip said pipe or release said pipe.

6. The system as claimed in claim 5 wherein said gripper means includes means for reducing possible damage in said drill pipe when said gripper means engages said drill pipe.

7. The system as claimed in claim 6 further including means to indicate when said gripper means are fully gripping said drill pipe or fully open.

8. A floor drive system for use on a gas or oil well drilling or production rig for imparting torque to a driven means, such as drill pipe or casing, near the rig floor and having a rotary table and a master bushing at the floor of said rig, comprising:

a pipe drive bushing having a pair of gripper assemblies for selectively gripping said driven means for imparting torque to said driven means in response to torque from said master bushing when said pipe bushing is coupled thereto, said pipe drive bushing further having means for engaging said master bushing and means for disengaging said pipe drive bushing and said master bushing so that pipe drive bushing may be moved on said rig floor to and from said master bushing.

9. The floor drive system as claimed in claim 8 wherein said pipe drive bushing comprises a frame enclosing a rotor connectable to said master bushing for rotation thereby and in which said gripper assemblies are mounted for rotation and travel upwardly and downwardly with respect to the rig floor.

10. The floor drive system as claimed in claim 9 wherein said frame and rotor include means for selectively raising and lowering individual gripper assemblies and wherein each said gripper assembly includes means for gripping and ungripping said driven means in response to rotation of said rotor by said master bushing.

11. The floor drive system as claimed in claim 10 wherein said rotor comprises a lower rotatable plate and upper rotatable plate, guide posts connected between said upper and lower rotatable plates so that said lower rotatable plate imparts torque from said master bushing through said guide posts to said gripper assemblies, said gripper assemblies being mounted for up and down travel on said guide posts.

12. The floor drive system as claimed in claim 11 wherein each gripper assembly includes means responsive to said rotation by said guide posts for gripping and releasing said driven means at selected times as said gripper assemblies travel upward and downward and means in said gripper assemblies to actuate said gripper assemblies to grip or release said driven means at a selected time.

13. The floor drive system as claimed in claim 12 wherein each gripper assembly comprises a plurality of rotatable rings and a non-rotatable ring, means on said rotatable rings including grippers for gripping and ungripping said driven means, and means cooperating with said non-rotatable ring to retard rotation of one or more of said rotatable rings to actuate said grippers so as to grip and un-grip said driven means.

14. The floor drive system as claimed in claim 13 wherein said grippers include means for cushioning said grippers as said grippers grip said driven means to reduce any damage that might be caused by said grippers as they grip said driven means.

15. The floor drive system as claimed in claim 14 wherein said grippers include means to indicate when said grippers have gripped said driven means and when said grippers are fully open and when said grippers have gripped an obstacle on said driven means.

16. In a oil and gas well drilling and reaming system, a gripper assembly means for gripping a pipe string selectively to impart torque to said pipe string as said pipe string is being raised or lowered, said gripper assembly means comprising a plurality of rings, a rotatable inner gripper body ring, a rotatable gripper ring, a rotatable ungripper ring and a non-rotatable brake ring, said inner gripper body ring including an anchor arm with two grippers and pivotally connected to said inner gripper body ring, said gripper ring having a leading arm with one gripper pivotally connected thereto, both said anchor arm and leading arm being connected by a connecting link having one gripper, said gripper body ring and said gripper ring being characterized such that relative rotation between said gripper body ring and said gripper ring will cause said grippers to engage said pipe, said ungripper ring being connected to said gripper body ring and said gripper ring and characterized such that relative rotation will cause said leading arm and anchored arm to disengage said pipe, first brake means in said brake ring for engaging said gripper ring to retard said gripper ring to cause said relative rotation between said inner body ring and said gripper ring and thus cause said grippers to grip said pipe, and second brake means in said brake ring for engaging said ungripper ring to retard said ungripper ring to cause said relative rotation between said inner body ring and said ungripper ring and thus cause said grippers to ungrip said pipe, said gripper assembly being characterized by having all of said rotatable rings continuously movable during gripping and ungripping.

17. The gripper assembly as claimed in claim 16 wherein each said gripper includes means for cushioning the gripper as it approaches gripping relationship with said pipe string.

18. In a system for drilling and producing oil or gas from wells which includes a rig having a hoist for raising and lowering a string of pipes, a master bushing located at the rig floor and having a rotary table for driving said master bushing, a method comprising the steps of, connecting vertically axially aligned gripper assemblies to said master bushing so as to be rotated thereby, selecting certain of said gripper assemblies to successively and sequentially engage the pipe string as said hoist is raising or lowering said pipe string, applying torque to the pipe string by the gripper assembly which is in engagement with said pipe string, said torque being applied by said rotary table and said master bushing for drilling, reaming, for casing setting operations, and causing said selected gripper assembly to move upwardly or downwardly a selected distance above said rig floor while engaging said pipe string.

19. The method as claimed in claim 18 wherein the non-selected gripper assemblies are also moved upwardly or downwardly a selected distance above said rig floor while out of engagement with said pipe string so as to be ready to engage said pipe string as said selected gripper assembly is caused to disengage said pipe string.

20. A method for drilling oil and gas wells in a rig which includes a hoist for raising and lowering pipe and rotary power means at the rig floor, including the steps of;

connecting vertically aligned grippers to said rotary power means, selecting certain of said grippers to successively and sequentially engage and move with said pipe so as to apply said torque to said pipe as said hoist is raising or lowering said pipe.

21. The method as claimed in claim 20 wherein the non-selected grippers are also moved upwardly or downwardly while out of engagement with said pipe so as to be ready to engage said pipe as said selected grippers are caused to disengage said pipe.

22. A floor drive system for use on a gas or oil well drilling or production rig for imparting torque at the rig floor to a driven means, such as drill pipe or casing, means for raising and lowering said driven means through said rig floor, rotary power means located at the rig floor, a drive bushing having a pair of vertically reciprocable gripper assemblies each of which selectively grip and release said driven means, and means for releasably coupling said drive bushing to said rotary means for applying torque to said driven means through said gripper assembly which is gripping said driven means.

23. The floor drive system as claimed in claim 22 wherein the ungripped gripper assembly is reciprocated so as to be ready to grip said driven means as the other gripper assembly releases said driven means.

24. The floor drive system as claimed in claim 23 wherein each gripper assembly includes means for reducing possible damage to said driven means when said selected gripper assembly grips said driven means.

25. The floor drive system as claimed in claim 23 further including means to indicate when said gripper assemblies are fully gripping said driven means or fully released from said driven means.

26. The floor drive system as claimed in claim 23 including means for reducing possible damage to said driven means when said gripper assemblies engage said driven means.

27. A floor drive system for use on a gas or oil well drilling or production rig for imparting torque to a driven means, such as drill pipe or casing, near the rig floor and having a rotary table and a master bushing at the floor of said rig, comprising:

a drive bushing having an opening larger than the diameter of the driven means and having means for releasably coupling said drive bushing to said master bushing, a pair of reciprocable gripper assemblies in said drive bushing for gripping said driven means for imparting torque to said drilling means when said drive bushing is coupled thereto, said gripper assemblies also having radial openings larger than the diameter of the driven means and operable between a gripping position for gripping said driven means and a fully open position for receiving said driven means and for removal of said driven means through said openings in said drive bushing and gripper assemblies if necessary.

* * * * *